US006035052A

United States Patent [19]

Fujihira et al.

[11] Patent Number: 6,035,052

[45] Date of Patent: Mar. 7, 2000

[54] ACOUSTIC TRANSDUCER

[75] Inventors: Masao Fujihira, Kanagawa; Makoto Yamagishi, Tokyo; Jun Kishigami, Saitama; Takahiro Muraguchi; Ikuo Shinohara, both of Tokyo, all of Japan

[73] Assignee: Sony Corporation, Tokyo, Japan

[21] Appl. No.: 09/048,078

[22] Filed: Mar. 26, 1998

[30] Foreign Application Priority Data

Mar. 31, 1997 [JP] Japan ..... P09-080746
Mar. 31, 1997 [JP] Japan ..... P09-080747

[51] Int. Cl.[7] ..... H04R 25/00

[52] U.S. Cl. ..... 381/401; 381/431; 381/412; 381/420

[58] Field of Search ..... 381/396, 398, 381/403, 412, 420, 423, 431, 401; 181/171, 172

[56] References Cited

U.S. PATENT DOCUMENTS 4,243,839 1/1981 Takahashi et al. ..... 381/401
5,255,328 10/1993 Akiniwa et al. ..... 381/398
5,467,323 11/1995 Sone ..... 381/396
5,487,114 1/1996 Dinh ..... 381/406
5,673,330 9/1997 Chang ..... 381/398
5,832,096 11/1998 Hall ..... 381/401

*Primary Examiner*—Sinh Tran
*Attorney, Agent, or Firm*—Jay H. Maioli

[57] ABSTRACT

An electromagnetic induction type acoustic transducer including a plate as an assembly of a magnetic circuit and having an opening of a predetermined diameter about a central axis, a pole piece as an assembly of the magnetic circuit and protruded on the central axis, having an outer peripheral diameter smaller than the opening of the plate and having an upper surface located lower than a lower surface of an opening peripheral portion of the plate by a predetermined distance, a lower surface portion of the opening peripheral portion of the plate and an upper surface portion of the pole piece constitute a magnetic gap of the magnetic circuit, a diaphragm vibrated in the upper and lower direction on the central axis at the position perpendicular to the central axis in the predetermined distance, an annular ring attached to the diaphragm at the position of the magnetic gap, and a coil attached to the plate and/or pole piece.

8 Claims, 12 Drawing Sheets

FIG. 12

| CURRENT | MSB | 2SB | 3SB | 4SB | 5SB | 6SB | 7SB | 8SB | 9SB | 10SB | 11SB | 12SB | 13SB | 14SB | 15SB | LSB |
|---|---|---|---|---|---|---|---|---|---|---|---|---|---|---|---|---|
| + | 0 | 1 | 1 | 1 | 1 | 1 | 1 | 1 | 1 | 1 | 1 | 1 | 1 | 1 | 1 | 1 |
| | 0 | 1 | 1 | 1 | 1 | 1 | 1 | 1 | 1 | 1 | 1 | 1 | 1 | 1 | 1 | 0 |
| | 0 | 1 | 1 | 1 | 1 | 1 | 1 | 1 | 1 | 1 | 1 | 1 | 1 | 1 | 0 | 1 |
| | 0 | 1 | 1 | 1 | 1 | 1 | 1 | 1 | 1 | 1 | 1 | 1 | 1 | 1 | 0 | 0 |
| | | | | | | | | | | | | | | | | |
| | 0 | 0 | 0 | 0 | 0 | 0 | 0 | 0 | 0 | 0 | 0 | 0 | 0 | 0 | 1 | 1 |
| | 0 | 0 | 0 | 0 | 0 | 0 | 0 | 0 | 0 | 0 | 0 | 0 | 0 | 0 | 1 | 0 |
| | 0 | 0 | 0 | 0 | 0 | 0 | 0 | 0 | 0 | 0 | 0 | 0 | 0 | 0 | 0 | 1 |
| 0 | 0 | 0 | 0 | 0 | 0 | 0 | 0 | 0 | 0 | 0 | 0 | 0 | 0 | 0 | 0 | 0 |
| | 1 | 1 | 1 | 1 | 1 | 1 | 1 | 1 | 1 | 1 | 1 | 1 | 1 | 1 | 1 | 0 |
| | 1 | 1 | 1 | 1 | 1 | 1 | 1 | 1 | 1 | 1 | 1 | 1 | 1 | 1 | 0 | 0 |
| | 1 | 1 | 1 | 1 | 1 | 1 | 1 | 1 | 1 | 1 | 1 | 1 | 1 | 1 | 0 | 0 |
| | | | | | | | | | | | | | | | | |
| | 1 | 0 | 0 | 0 | 0 | 0 | 0 | 0 | 0 | 0 | 0 | 0 | 0 | 0 | 1 | 1 |
| | 1 | 0 | 0 | 0 | 0 | 0 | 0 | 0 | 0 | 0 | 0 | 0 | 0 | 0 | 1 | 0 |
| | 1 | 0 | 0 | 0 | 0 | 0 | 0 | 0 | 0 | 0 | 0 | 0 | 0 | 0 | 0 | 1 |
| − | 1 | 0 | 0 | 0 | 0 | 0 | 0 | 0 | 0 | 0 | 0 | 0 | 0 | 0 | 0 | 0 |
| COIL | | 1O | 1N | 1M | 1L | 1K | 1J | 1I | 1H | 1G | 1F | 1E | 1D | 1C | 1B | 1A |

ACOUSTIC TRANSDUCER

BACKGROUND OF THE INVENTION

1. Field of the Invention

The present invention relates to an acoustic transducer of electromagnetic coupling type (electromagnetic induction type), i.e. a transducer such as a speaker or a headphone for converting an electrical signal into acoustic sounds and a transducer such as a microphone for converting acoustic sounds into an electrical signal.

2. Description of the Related Art

In the case of an external magnetic type, for example, an acoustic transducer of an electromagnetic coupling type comprises a magnetic circuit having a magnetic gap formed between a plate and a center pole across a magnet composed of the plate, the center pole and a yoke and in which a first coil is fixed to the plate or the center pole within the magnetic gap of the magnetic circuit and an insulated second coil is fixed to a diaphragm in an opposing relation to the first coil within the magnetic gap of the magnetic circuit.

In a transducer such as a speaker or a headphone, when a first coil is used as a drive coil (primary coil) and a signal current is supplied to this drive coil, a secondary current corresponding to the signal current is induced in a second coil serving as a secondary coil by an electromagnetic coupling. Then, owing to Fleming's left-hand rule, a drive force corresponding to a signal current is generated in the second coil, and the diaphragm to which the second coil is fixed is vibrated to generate a sound pressure corresponding to the signal current.

FIGS. 13 and 14 show examples of electromagnetic coupling type speakers according to the related art, respectively. FIG. 13 shows the example of the electromagnetic coupling type speaker in which a drive coil is attached to a plate. FIG. 14 shows the example of the electromagnetic coupling type speaker in which a drive coil is attached to a center pole.

In the electromagnetic coupling type speaker shown in FIG. 13, a center pole 11 is unitarily formed at the center portion of the upper surface of a flange-like yoke 10. A magnet 20 is attached to the upper surface of the circumferential portion of the yoke 10. A magnetic circuit 6 is formed so as to have a magnetic gap 5 formed between an outer peripheral surface of a tip end portion of the center pole 11 and an inner peripheral surface of the plate 30, and a drive coil 1 is attached to the inner peripheral end surface of the plate 30.

The yoke 10 has a hole 12 defined at its bottom portion and also has a terminal assembly 4 with an input terminal 3 attached to its lower surface. A lead wire 2 of the drive coil 1 is inserted into the hole 12 and connected to the input terminal 3 by soldering. The lead wire 2 is each attached to the start of the winding and the end of the winding of the drive coil 1, and each connected to a separate input terminal.

A secondary coil 7 is inserted into the magnetic gap 5. The secondary coil 7 is either an insulated cylinder of one turn made of a nonmagnetic conductive material such as aluminum or an insulated winding having a plurality of turns.

A lower portion of a frame 40 is attached to the upper surface of the plate 30. An outer peripheral portion of an upper end of a diaphragm 50 such as a cone is attached through an edge 51 and a gasket 45 to an upper inner peripheral end portion of the frame 40. An outer peripheral portion of a damper 47 is attached to the frame 40, and a lower end portion of the diaphragm 50 and an inner peripheral portion of the damper 47 are attached to the secondary coil 7. A center cap 49 is attached to a lower end portion of the diaphragm 50 or an upper end portion of the secondary coil 7.

In the electromagnetic coupling type speaker shown in FIG. 14, a recess is formed around the outer peripheral surface of the upper end portion of the center pole 11, and the drive coil 1 is attached to the center pole 11 by means of this recess. The rest of the elements and parts in FIG. 14 are similar to that of the electromagnetic coupling type speaker shown in FIG. 13.

In the electromagnetic coupling type speaker shown in FIG. 13 or 14, when a signal current is supplied to the drive coil 1, a secondary current corresponding to the signal current is induced in the secondary coil 7 due to an electromagnetic coupling. Then, owing to the Fleming's left-hand rule, a drive current corresponding to the signal current is generated in the secondary coil 7, and the diaphragm 50 with the secondary coil 7 attached thereto is vibrated in the upper and lower direction, thereby resulting in a sound pressure corresponding to the signal current being generated.

However, in the related-art electromagnetic coupling type speaker shown in FIG. 13 or 14, since the drive coil 1 is disposed within the magnetic gap 5 of the magnetic circuit 6, the width (length of the direction perpendicular to the axis of the speaker) of the magnetic gap 5 cannot be reduced by the thickness of the drive coil 1 so that a magnetic force of the magnetic gap 5 is reduced, thereby resulting in the sensitivity of the speaker being lowered. If a large magnet is used as the magnet 20 in order to increase the magnetic force of the magnetic gap 5 and to increase the sensitivity of the speaker, the speaker becomes large in size and cannot be produced inexpensively.

In addition, if the turn number of the drive coil increases in order to increase the inductance of the drive coil 1, then the width of the magnetic gap 5 increases so that the sensitivity of the speaker is lowered. Hence, the inductance of the drive coil cannot increase. As a result, an electromagnetic coupling force between the drive coil 1 and the secondary coil 7 is too weak in a low band range of less than 2 kHz to reproduce low-frequency signals of large amplitude. Hence, the electromagnetic coupling speaker according to the related art can be used only to reproduce high-frequency signals.

Furthermore, while the outer or inner circumferential surface of the drive coil 1 contacts with the plate 30 or the center pole 11, its contact area is small so that heat cannot be radiated from the drive coil 1 instantly. As a consequence, not only may a thick wire material not be used as the drive coil 1 but also a large current cannot be quickly conducted to the drive coil 1 with the result that an allowable input signal level cannot be increased.

While the case in which the electromagnetic coupling type transducer is applied to the speaker has been described so far, this is also true in other transducer such as the headphone. The transducer such as the microphone has a similar arrangement except only that the input and output are reversed.

SUMMARY OF THE INVENTION

In view of the aforesaid aspect of the present invention, it is an object of the present invention to provide an electromagnetic induction type acoustic transducer in which a sensitivity can be increased without making the acoustic transducer large in size and without making the acoustic transducer expensive.

It is another object of the present invention to provide an electromagnetic induction type acoustic transducer in which sounds of low tone can be reproduced or picked up, therebymaking it possible to realize a transducer of whole band range type or a transducer specialized in reproducing low-frequency signals of large amplitude.

It is a further object of the present invention to provide an electromagnetic induction type acoustic transducer in which an allowable input level of a transducer can be increased from a standpoint of a head-radiation of a first coil.

According to an aspect of the present invention, there is provided an electromagnetic induction type acoustic transducer which is comprised of a plate as an assembly of a magnetic circuit and having an opening of a predetermined diameter about a central axis, a pole piece as an assembly of the magnetic circuit and protruded on the central axis, having an outer peripheral diameter smaller than the opening of the plate and having an upper surface located lower than a lower surface of an opening peripheral portion of the plate by a predetermined distance, a lower surface portion of the opening peripheral portion of the plate and an upper surface portion of the pole piece constitute a magnetic gap of the magnetic circuit, a diaphragm vibrated in the upper and lower direction on the central axis at the position perpendicular to the central axis in the predetermined distance, an annular ring attached to the diaphragm at the position of the magnetic gap, and a coil attached to the plate and/or pole piece.

BRIEF DESCRIPTION OF THE DRAWINGS

FIG. 12 is a diagram showing a relationship between bits of a digital signal and coils in the transducer assembly shown in FIG. 11.

DETAILED DESCRIPTION OF THE PREFERRED EMBODIMENTS

The manner in which several embodiments according to the present invention are applied to an electromagnetic induction type speaker will be described hereinafter. However, these embodiments are only examples of the present invention, and the present invention is not limited to those embodiments. For example, if the input/output system is reversed, then the present invention may also be applied to a microphone.

While the following embodiments according to the present invention are applied to an electromagnetic induction type acoustic transducer of an internal magnet type, the present invention is not limited thereto and may, of course, be applied to an electromagnetic induction type acoustic transducer of an external magnet type.

Figure 1:
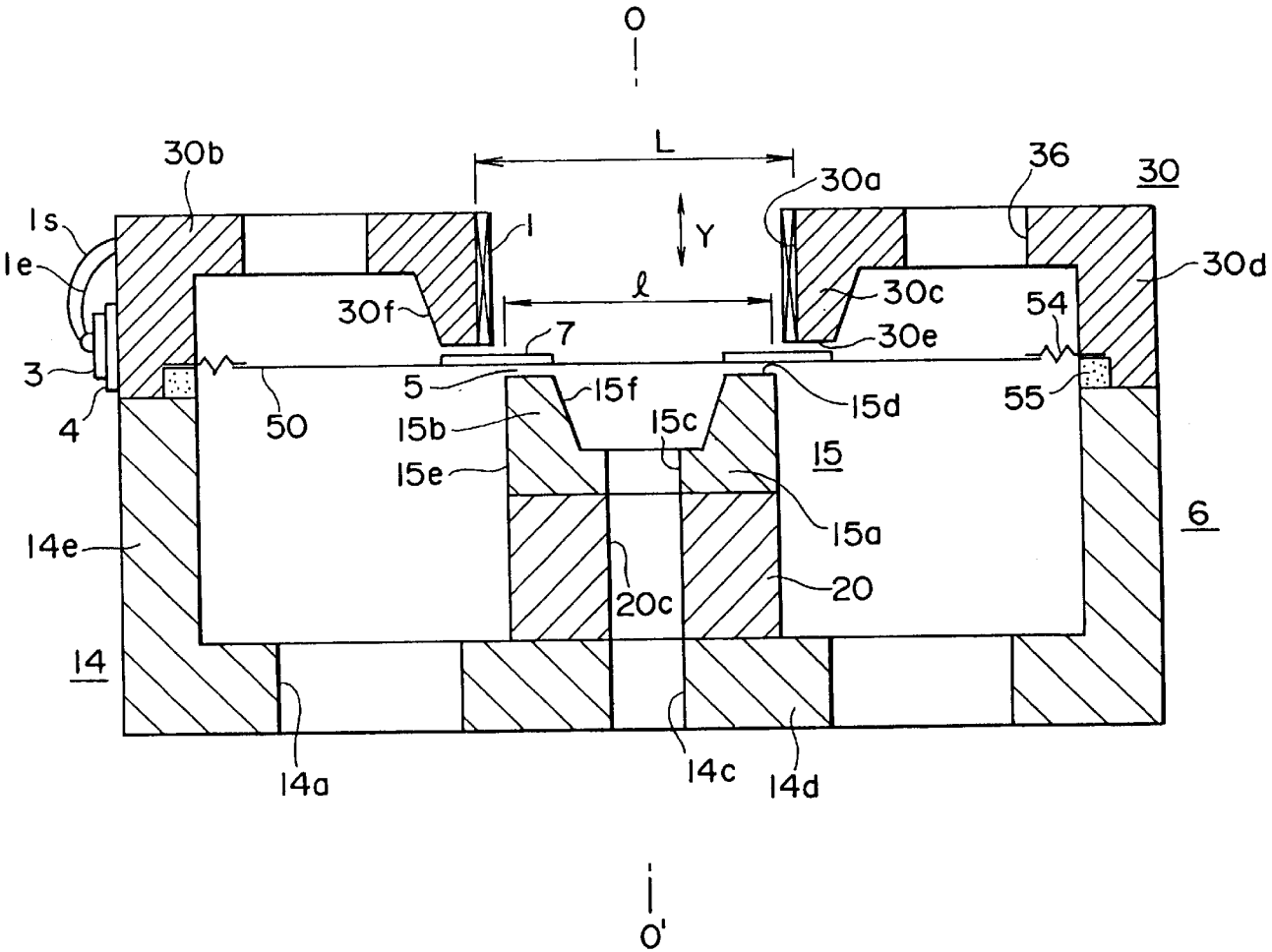
FIG. 1 is a cross-sectional view showing an acoustic transducer according to a first embodiment of the present invention in an enlarged scale.

FIG. 1 shows an acoustic transducer according to a first embodiment of the present invention. In the first embodiment, the present invention is applied to an internal magnet type electromagnetic coupling speaker in which a drive coil is attached to a plate.

In this embodiment, as shown in FIG. 1, there is prepared a yoke 14 which comprises a disk-like flange portion 14*d* made of a magnetic material and a cylindrical body 14*e* unitarily formed on the upper peripheral portion of the disk-like flange portion 14*d*. A cylindrical magnet 20 is attached to the upper central portion of the flange portion 14*d* of the yoke 14, and a pole piece 15 made of a magnetic material is attached to the upper surface of this magnet 20. Then, the magnet 20 and the pole piece 15 constitute a center pole. Incidentally, the pole piece 15 comprises a disk-like flange portion 15*a* and a cylindrical body 15*b* unitarily formed on the upper outer circumferential portion of the disk-like flange portion 15*a*. A plate 30 made of a magnetic material is attached to the upper end face of the cylindrical body 14*e* of the yoke 14. This plate 30 comprises an annular flange portion 30*b* having a central opening 30*a* with a predetermined diameter about a central axis 0–0', an inner cylindrical body 30*c* and an outer cylindrical body 30*d*, each of which is unitarily formed on the lower surface of this flange portion 30*b*. Then, the lower end face of the outer cylindrical body 30*d* of the plate 30 is attached to the upper end face of the cylindrical body 14*e* of the yoke 14. Thus, a magnetic gap 5 is formed between the upper end face 15*d* of the cylindrical body 15*b* of the pole piece 15 and the lower end face 30*e* of the inner cylindrical body 30*c* of the plate 30. Then, a diameter of the upper end face of the cylindrical body 15*b* of the pole piece 15 is selected to be smaller than the inner peripheral side surface of the inner cylindrical body 30*c* of the plate 30, i.e. a diameter L of the central opening 30*a*, whereby a main magnetic flux path is obliquely formed within the magnetic gap 5. The central axes of the central opening 30*a*, the flange 15*a* of the pole piece 15 and the flange 14*d* of the yoke 14 agree with the central axis 0–0'.

The yoke 14, i.e. flange portion 14*d* has a central through-hole 14*c* around which there is formed a window 14*a*. The magnet 20 has a central through-hole 20*c* which communicates with the central through-hole 14*c* of the yoke 14. The pole piece 15 has an outer diameter equal to or a little larger than that of the magnet 20. The pole piece 15 also has a central through-hole 15*c* which communicates with the central through-hole 20*c* of the magnet 20.

Figure 6A:
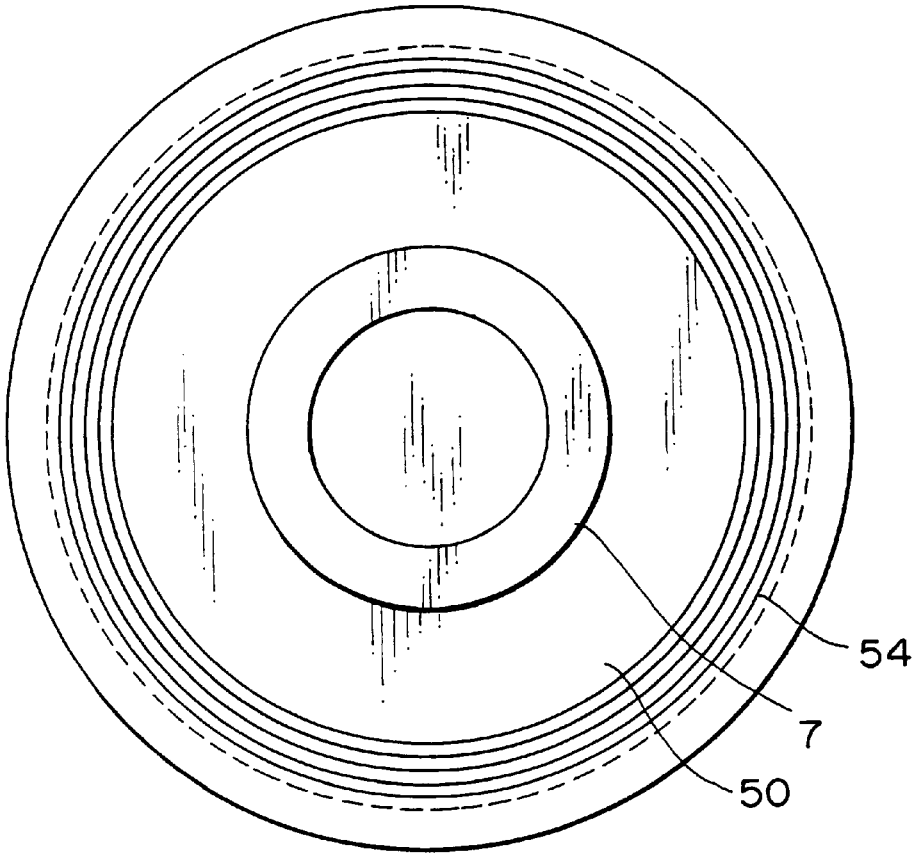
FIG. 6A is a top view of a diaphragm.
Figure 6B:
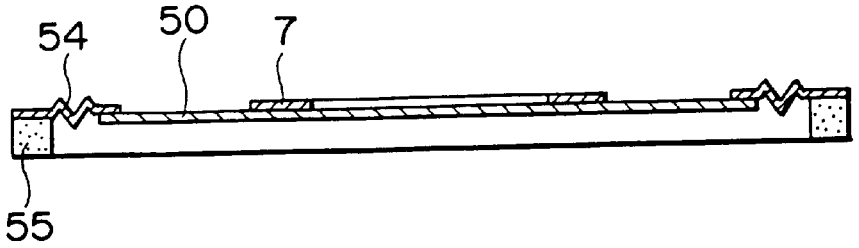
FIG. 6B is a cross-sectional view of the diaphragm.

A diaphragm 50 is a circular diaphragm made of an insulating thin plate such as a polyester film as shown in FIG. 6A, and shaped like a flat plate as shown in FIG. 6B. Specifically, as shown in FIGS. 6*a* and 6B, an flat, annular and insulated secondary coil 7 is formed on the diaphragm 50 by pasteing of metal foils or vapor deposition of metal, an annular corrugated edge 54 is formed around the outermost peripheral portion of the diaphragm 50, and a diaphragm ring 55 is attached to the outer peripheral portion of the corrugated edge 54.

Then, the diaphragm 50 with the secondary coil 7 fixed thereto is disposed within the magnetic gap 5 in the horizontal direction (in the direction perpendicular to the central axis 0–0') in such a manner that it may be located between the upper end face 15*d* of the pole piece 15 and the lower end face 30*e* of the plate 30 and that it may not contact with the upper end face 15*d* and the lower end face 30*e*. The diaphragm 50 is attached by bonding the diaphragm ring 5 to the lower end face of the outer cylindrical body 30*d*.

Figure 5:
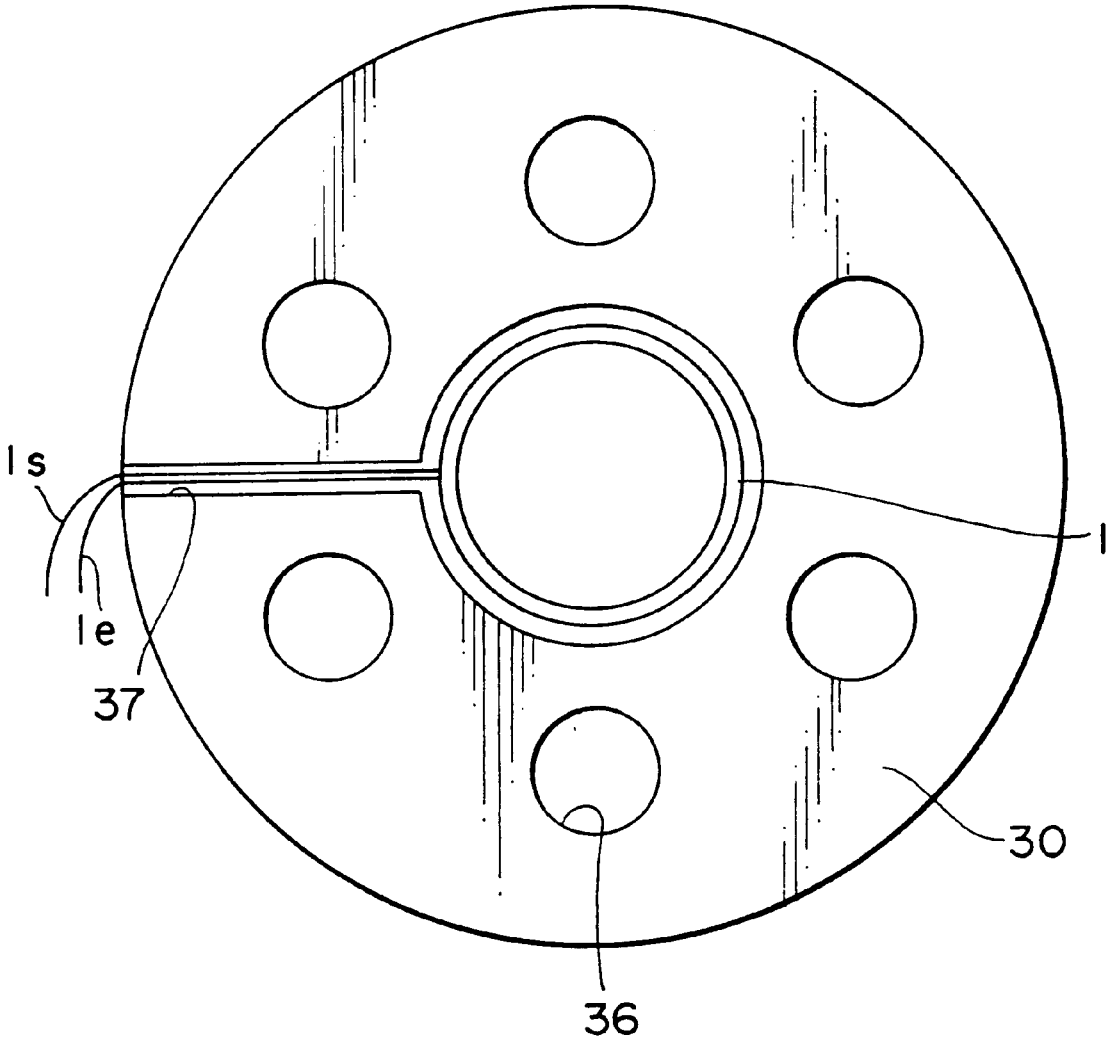
FIG. 5 is a top view of a plate.

As shown in FIG. 5 (plan view showing the speaker from above), the plate 30 has windows 36 defined thereon, and also has a slit 37 formed at a predetermined position.

Figure 7:
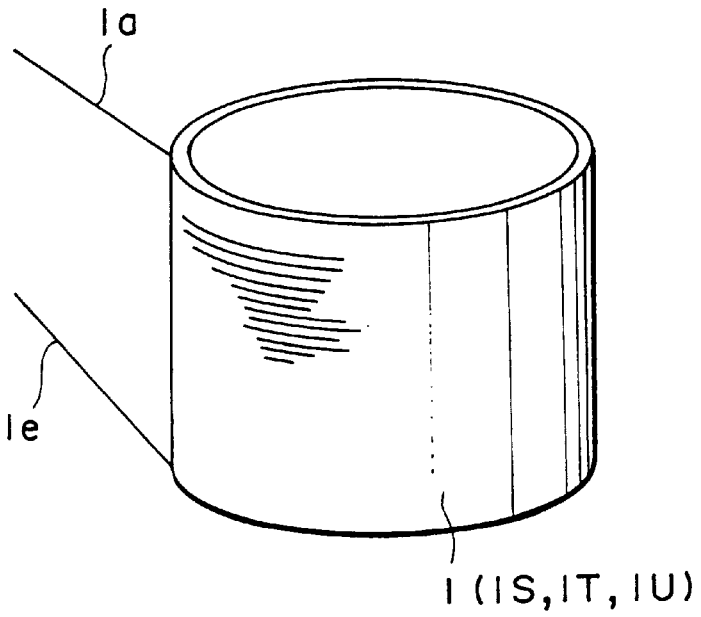
FIGS. 7 through 10 are perspective views showing examples of drive coils, respectively.

As shown in FIG. 7, the drive coil 1 includes a winding having one end side of the axial direction as a winding start portion and the other side of the axial direction as a winding end portion. The drive coil 1 is formed by winding wires in a spiral and cylindrical shape (in a spiral staircase fashion), and has lead wires 1*s* and 1*e* led out from the winding start portion and the winding end portion.

Then, the drive coil 1 is bonded to the inner peripheral side surface 30*a* of the inner cylindrical body 30*c* of the plate 30 by an adhesive. The lead wires 1*s* and 1*e* of the drive coil 1 are fixed within the slit 37 of the plate 30 by an adhesive, and led out to the outside of the plate 30.

Then, as shown in FIG. 1, the terminal assembly 4 with the input terminal 3 attached thereto is attached to the outer peripheral side surface of the outer cylindrical body 30*d* of the plate 30, for example, and the lead wires 1*s* and 1*e* led out to the outside of the plate 30 are connected to the input terminal 3 by soldering. The lead wires 1*s* and 1*e* are connected to separate input terminals, respectively.

Then, the secondary coil 7 on the diaphragm 50 disposed in a predetermined distance between the upper end face 15*d* of the pole piece 15 and the lower end face 30*e* of the plate 30, i.e. in the magnetic gap 5 is located in such a manner that it crosses the magnetic flux path of the oblique direction.

In the above-mentioned electromagnetic coupling speaker, when a signal current is supplied to the drive coil 1, a secondary current corresponding to a signal current is induced in the secondary coil 7 due to an electromagnetic coupling and a drive force corresponding to the signal current is generated in the secondary coil 7 by a horizontal direction component of magnetic flux of the oblique direction which passes the magnetic gap 5 owing to Fleming's left-hand rule. Then, the diaphragm to which the secondary coil 7 is fixed is vibrated in the upper and lower directions shown by an arrow Y in FIG. 1, thereby resulting in a sound pressure corresponding to the signal current being generated.

The electromagnetic coupling speaker shown in FIG. 1 can be assembled by the following method.

Initially, the drive coil 1 is wound as described above. Then, the drive coil 1 is bonded to the inner peripheral side surface 30*a* of the inner cylindrical body 30*c* of the plate 30 by an adhesive. Then, the lead wires 1*s* and 1*e* are fixed within the slit 37 of the plate 30 by an adhesive, and led out to the outside of the plate 30.

The terminal assembly 4 to which the input terminal 3 is attached in advance is attached to the plate 30, and the lead wires 1*s* and 1*e* led out to the outside of the plate 30 are connected to the input terminal 3. Also, the secondary coil 7 is formed on the diaphragm 50 as described above, and the corrugated edge 54 and the diaphragm ring 55 are attached to the diaphragm 50.

Then, the central upper surface of the flange portion 14*d* of the yoke 14 is coated with an adhesive and on which the magnet 20 precisely rests before the magnet 20 is magnetized. At that time, the center of the flange portion 14*d* of the yoke 14 and the center of the magnet 20 are made concentric.

Then, the upper surface of the magnet 20 is coated with an adhesive and on which the pole piece 15 rests. The outer diameter of the pole piece 15 becomes concentric with the inner diameter of the yoke 14.

Then, the diaphragm with the diaphragm ring 55 attached thereto is attached to the inner peripheral side surface of the outer cylindrical body 30*d* of the plate 30 by an adhesive. If the secondary coil 7 is formed in advance at a predetermined position on the diaphragm 50, then at that time, the secondary coil 7 can be placed at a predetermined position within the magnetic gap 5.

Then, the lower end face of the outer cylindrical body 30*d* of the plate 30 is attached to the upper end face of the cylindrical body 14*e* of the yoke 14. Thus, there is formed the magnetic gap 5 between the upper end face 15*d* of the pole piece 15 and the lower end 30*e* of the plate 30.

After the adhesive has dried, the magnet 20 is magnetized in such a manner that the front side becomes N pole and the rear side becomes S pole or that the rear side becomes N pole and the front side becomes S pole. Thus, the assembly of the speaker is completed.

According to the arrangement of this embodiment, only one end of the axis direction 0–0' of the drive coil 1 is facing the magnetic gap 5, and the drive coil 1 does not exist within the magnetic gap 5. Accordingly, the width of the magnetic gap 5 becomes equal to one which results from adding a clearance to the thicknesses of the diaphragm 50 and the secondary coil 7. Thus, the thicknesses of the diaphragm 50 and the secondary coil 7 can be reduced sufficiently, whereby the width (length along the axis direction 0–0') of the magnetic gap 5 can be reduced sufficiently without considering the line wire diameter and the number of turns of the drive coil 1. Therefore, without using a large magnet as the magnet 20, i.e. without making the speaker become large in size and without making the speaker become expensive, the magnetic force at the magnetic gap 5 can be increased so that the sensitivity of the speaker can be improved.

In actual practice, if the thicknesses of the diaphragm 50 and the secondary coil 7 are about 0.15 mm, then the width of the magnetic gap 5 can be considerably reduced to about 0.55 mm which results from adding 0.40 mm total clearance to 0.15 mm.

In addition, if the number of turns of the drive coil 1 increases in order to increase the inductance of the drive coil 1, then the width of the magnetic gap 5 is not increased and the sensitivity of the speaker is not lowered. Thus, the inductance of the drive coil 1 can be increased. As a consequence, the electromagnetic force between the drive coil 1 and the secondary coil 7 can be increased even in the low band range, thereby making it possible to reproduce low-frequency signals of large amplitude. Therefore, it is possible to realize a speaker of a whole band range or a speaker exclusively-designed for reproducing low-frequency signals of large amplitude.

When the electromagnetic coupling type speaker according to this embodiment is formed as a speaker exclusively-designed for reproducing sounds of a low tone, the thickness of the diaphragm 50 or the secondary coil 7 is increased a little, the weight of the diaphragm 50 or the secondary coil 7 is increased, and the speaker suspension system is made to have high compliance so that the minimum resonance frequency of the speaker vibration system should preferably be lowered.

Further, according to the electromagnetic coupling speaker of this embodiment, since the drive coil 1 contacts with the plate 30 at its wide outer peripheral surface, heat can be radiated from the drive coil 1 sufficiently. Therefore, a wire material as thick as 0.25 mm diameter, for example, can be used as the drive coil 1 and also a large current can be rapidly flowed to the drive coil 1. Thus, the level of the allowable input signal can be raised.

Having put these aspects together, it is to be noted that, according to the electromagnetic coupling type speaker of this embodiment, it is possible to realize a speaker of a whole band range or a speaker exclusively-designed for reproducing low-frequency signals of large amplitude which can be miniaturized and made inexpensive and which can be made high in sensitivity and large in input/output characteristics.

Figure 2:
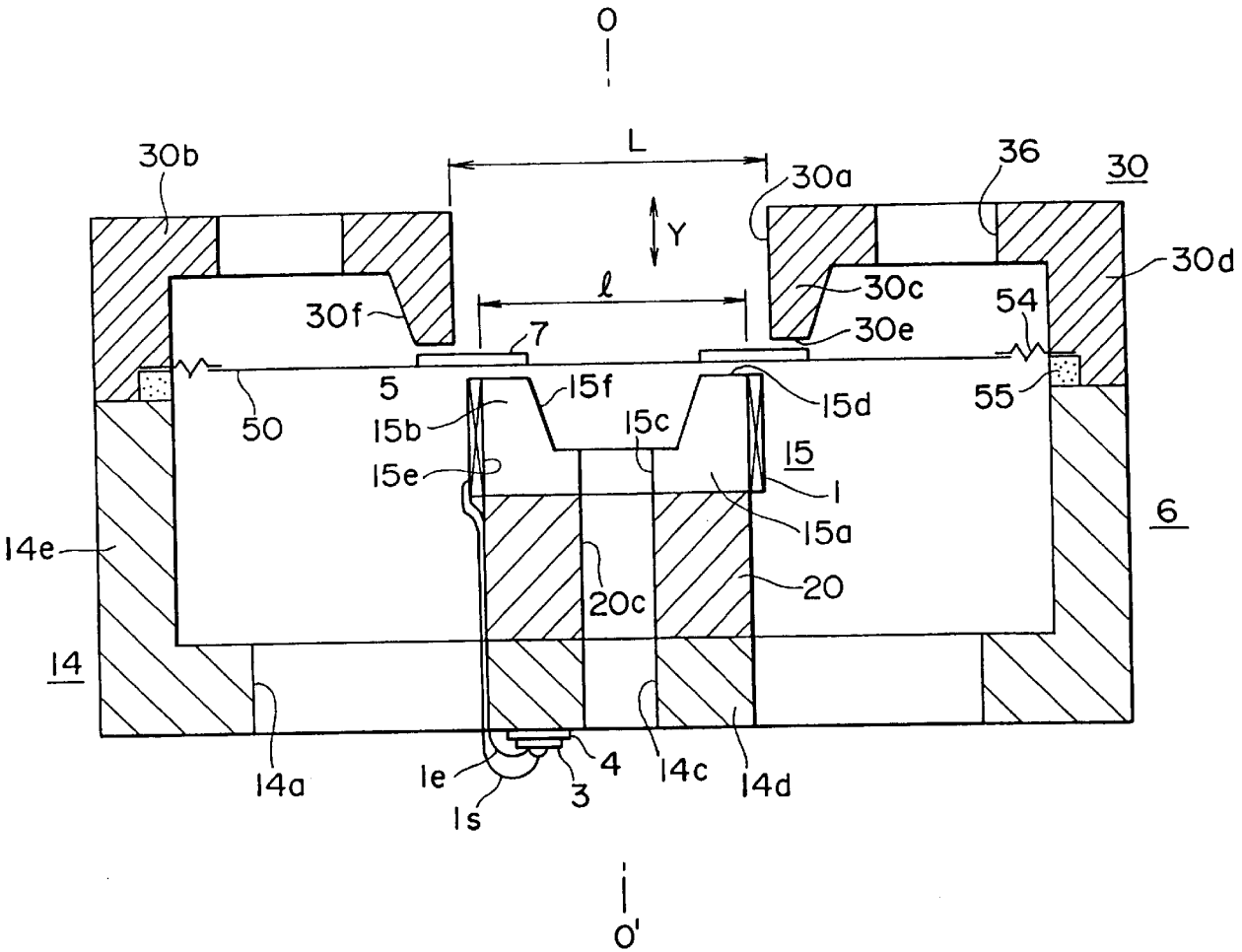
FIG. 2 is a cross-sectional view showing an acoustic transducer according to a second embodiment of the present invention in an enlarged scale.

FIG. 2 shows an acoustic transducer according to a second embodiment of the present invention in which the acoustic transducer is an internal magnet-type electromagnetic coupling speaker and in which a pole piece is provided with a drive coil.

According to this embodiment, as shown in FIG. 2, the drive coil 1 that is wound in a cylindrical fashion is attached to the outer peripheral side surface of the cylindrical body 15*b*. In this case, the terminal assembly 4 with the input terminal 3 attached thereto is attached to the lower surface of the flange portion 14*d* of the yoke 14, for example. The lead wires 1*s* and 1*e* of the drive coil 1 are fixed by an adhesive to the outer peripheral surface of the magnet 20, and connected to the input terminal 3 through the window 14*a* defined in the flange portion 14*d* of the yoke 14. The rest of the arrangement shown in FIG. 2 is similar to that of the first embodiment shown in FIG. 1.

According to the second embodiment, similar to the first embodiment, it is possible to realize a speaker of a whole band range or a speaker exclusively-designed for reproducing low-frequency signals of large amplitude which can be miniaturized and produced inexpensively and which can be made high in sensitivity and can be made large in input/output characteristics.

Incidentally, while the drive coil 1 is disposed on the inner peripheral side surface 30*a* of the inner cylindrical body 30*c* of the plate 30 and the outer peripheral side surface 15*e* of the cylindrical body 15*b* of the pole piece 15 in the first embodiment (FIG. 1) and the second embodiment (FIG. 2), respectively, the present invention is not limited thereto, and the following variant is also possible. In FIG. 1, for example, the outer peripheral side surface 30*f* of the inner cylindrical body 30*c* of the plate 30 may be formed as the side surface which is parallel to the central axis 0–0', and the drive coil 1 may be disposed along the outer peripheral side surface 30*f*. Similarly, in FIG. 2, the inner side surface 15*f* of the cylindrical body 15*d* of the pole piece 15 may be formed as the surface which is parallel to the central axis 0–0', and the drive coil 1 may be disposed along this inner peripheral side surface 15*f*.

Figure 8:
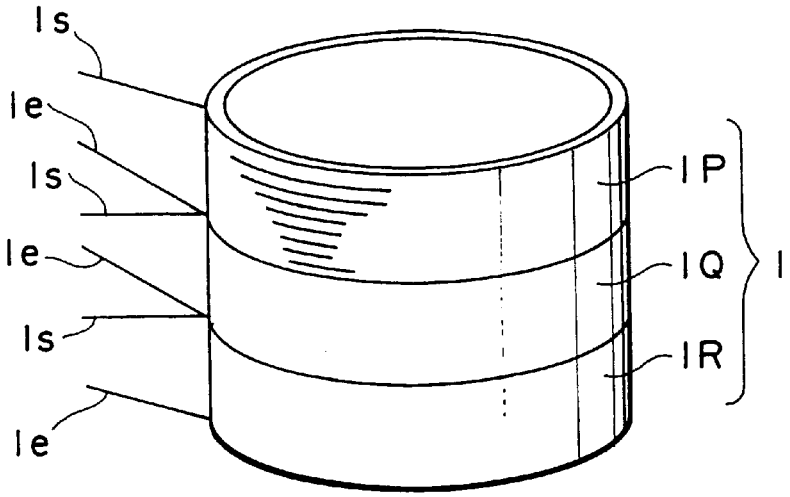

As shown in FIG. 8, the above-mentioned drive coil 1 may comprise three coils 1P, 1Q, 1R, for example, each of which is divided and wound in the axis 0–0' direction. In this case, in each of the coils 1P, 1Q, 1R, one end side of the axis 0–0' direction is used as a winding start portion and the other end side is used as a winding end portion. Lead wires 1*s* and 1*e* are led out from the winding start portion and the winding end portion, respectively.

In this case, since the respective coils 1P, 1Q, 1R are connected in parallel, a large input current can be applied to the drive coil 1 using a thin wire material, and a resistance on the primary side of the speaker can be reduced. Thus, matching an amplifier which drives the speaker can be made easy.

Figure 3:
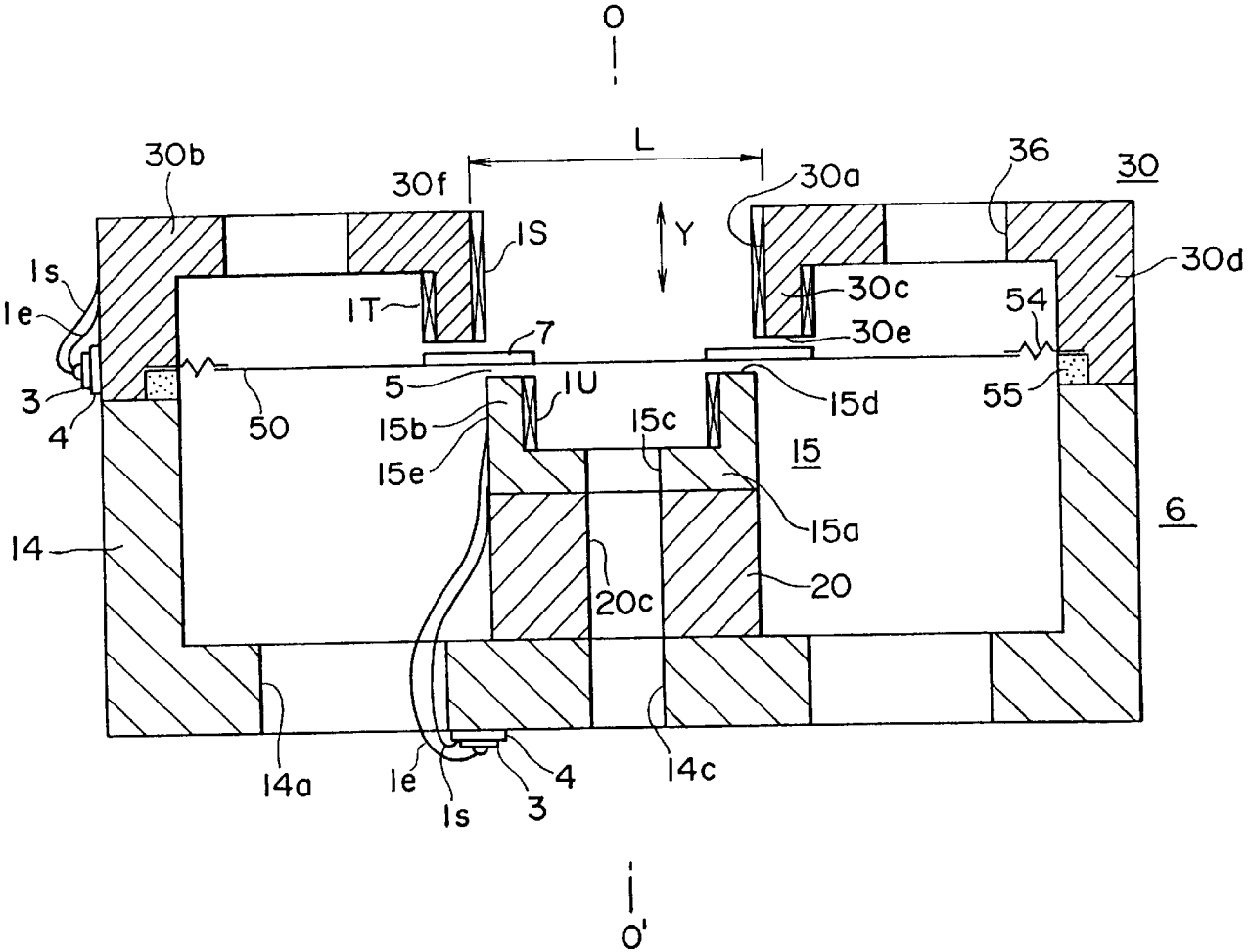
FIG. 3 is a cross-sectional view showing an acoustic transducer according to a third embodiment of the present invention in an enlarged scale.

FIG. 3 shows an acoustic transducer according to a third embodiment of the present invention. In this embodiment, the acoustic transducer is an internal magnet type electromagnetic coupling speaker, and drive coils are disposed in a plate and a pole piece.

In this embodiment, drive coils 1S and 1T are attached to an inner peripheral side surface 30*a* and an outer peripheral side surface 30*f* of an inner cylindrical body 30*c* of the plate 30, respectively, and a drive coil 1U is attached to an inner peripheral side surface 15*f* of a cylindrical body 15*b* of the pole piece 15. Incidentally, in this embodiment, the inner peripheral side surface 30*a* and the outer peripheral side surface 30*f* of the plate 30 and the inner peripheral side surface 15*f* of the cylindrical body 15*b* of the pole piece 15 are surfaces parallel to the axis 0–0'.

As shown in FIG. 7, in each of the drive coils 1S, 1T, 1U, one end side of the axis 0–0' direction is used as a winding start portion, and the other end side is used as a winding end portion. Each of the drive coils 1S, 1T, 1U has a spiral and cylindrical winding, and the lead wires 1*s* and 1*e* are led out from the winding start portion and the winding end portion, respectively.

In this case, the drive coils 1S, 1T and 1U may be connected in series. In that case, an inductance may be increased by increasing the number of turns of one drive coil on the whole.

Also, the drive coils 1S, 1T and 1U may be connected in parallel to each other. In that case, since a larger input current may be flowed to one drive coil on the whole and a resistance on the primary side of the speaker may be reduced, matching with an amplifier which drives a speaker may be made easy.

The arrangement shown in FIG. 3 may be applied to a speaker which is driven by a digital audio signal.

Figure 9:
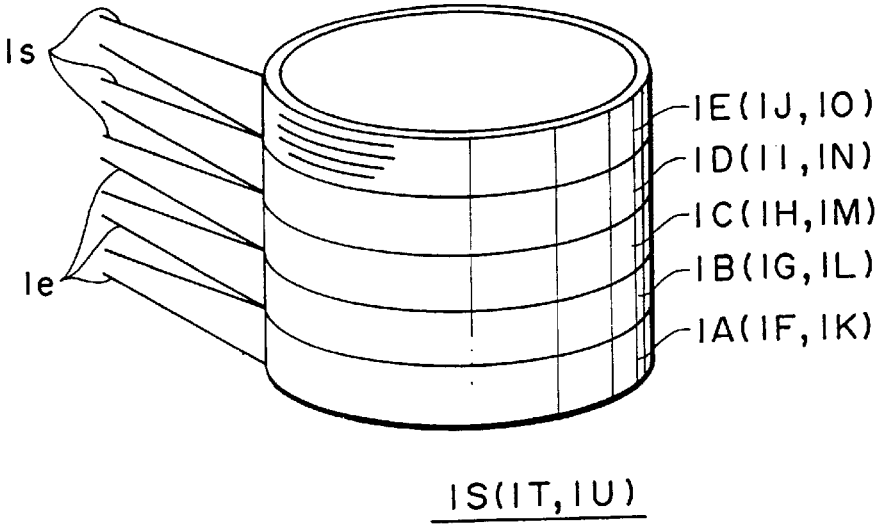

As shown in FIG. 9, the drive coils 1S, 1T and 1U are divided along the axis 0–0' direction to provide five coils 1E to 1A, 1J to 1F and 1O to 1K each of which has an equal number of turns. In that case, in each of the coils 1E to 1A, 1J to 1F and 1O to 1K, one end side of the axis 0–0' direction is used as a winding start portion and the other end side is used as a winding end portion. The lead wires 1*s* and 1*e* are led out from the winding start portion and the winding end portion.

Figure 10:
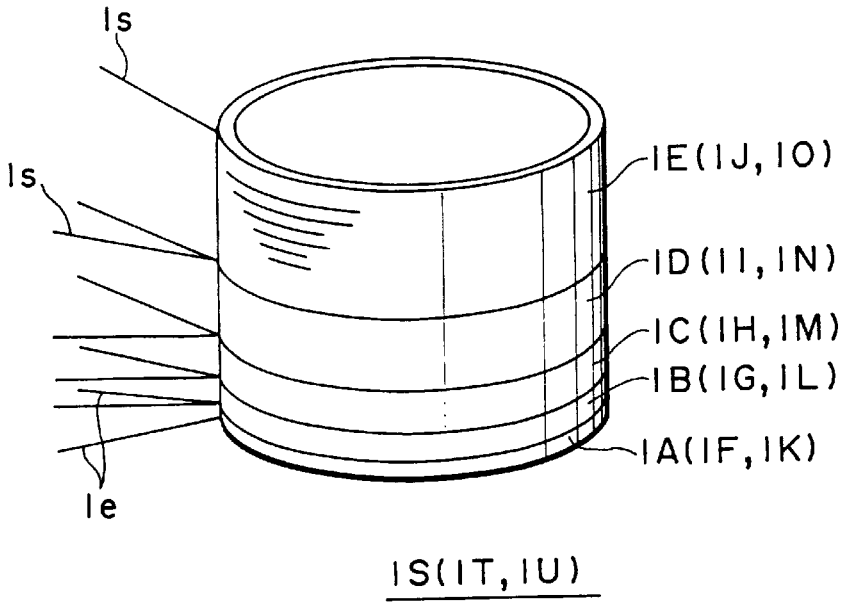

Also, as shown in FIG. 10, the drive coils 1S, 1T and 1U may be divided along the axis 0–0' direction to provide five coils 1E to 1A, 1J to 1F and 1O to 1K in which the ratio of the number of turns becomes N:N/2:N/4:N/8:N/16. Also in this case, in each of the coils 1E to 1A, 1J to 1F and 1O to 1K, one end side of the axis 0–0' direction may be used as the winding start portion and the other end may be used as the winding end portion. Then, the lead wires 1*s* and 1*e* may be led out from the winding start portion and the winding end portion, respectively.

Then, when the drive coils are divided to provide 15 coils 1A to 1O in total, the drive coils may be driven by a 16-bit digital audio signal.

Figure 11:
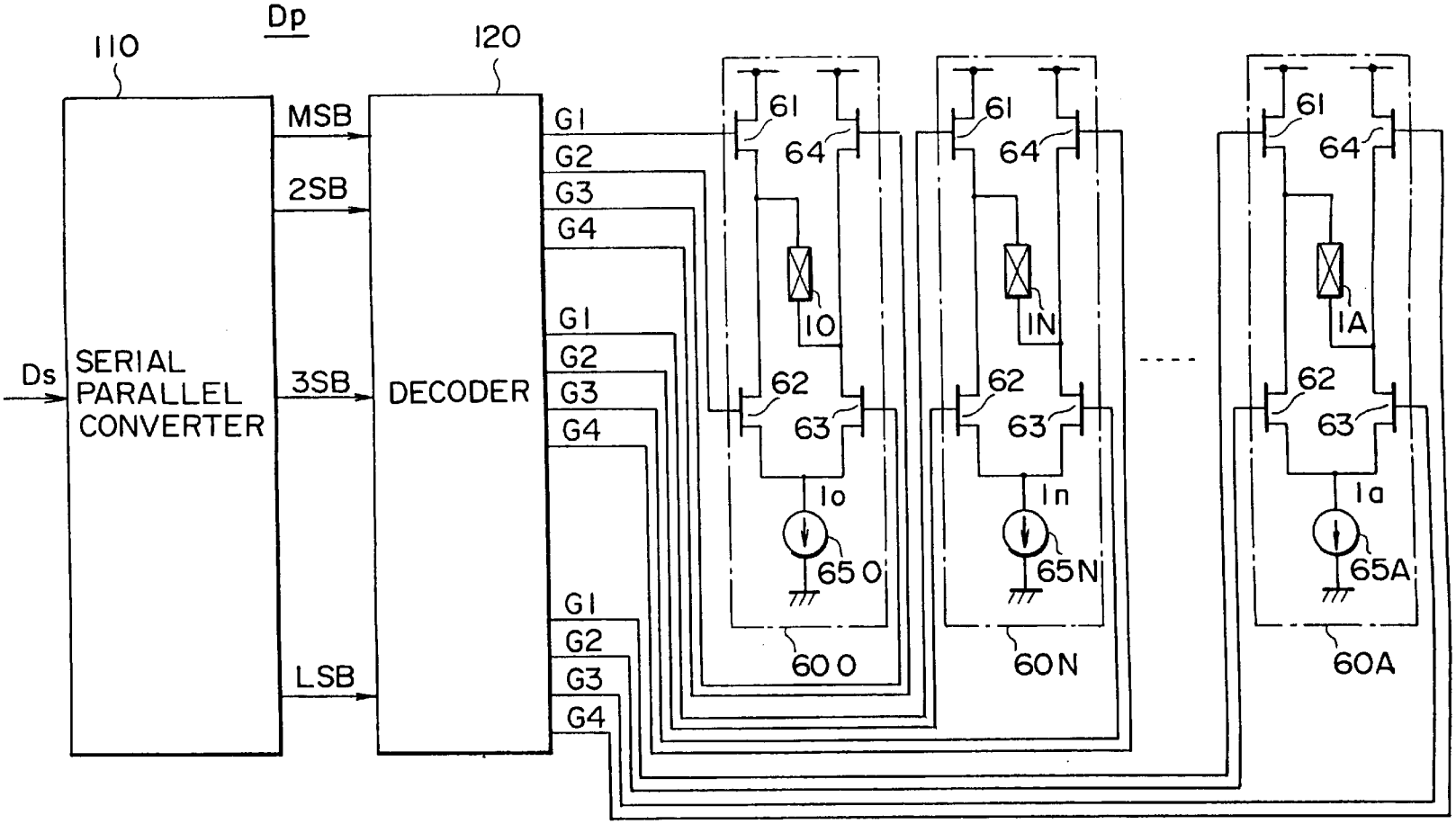
FIG. 11 is a block diagram showing a transducer assembly including a drive apparatus used when an acoustic transducer according to the present invention is driven by a digital audio signal.
Figure 13:
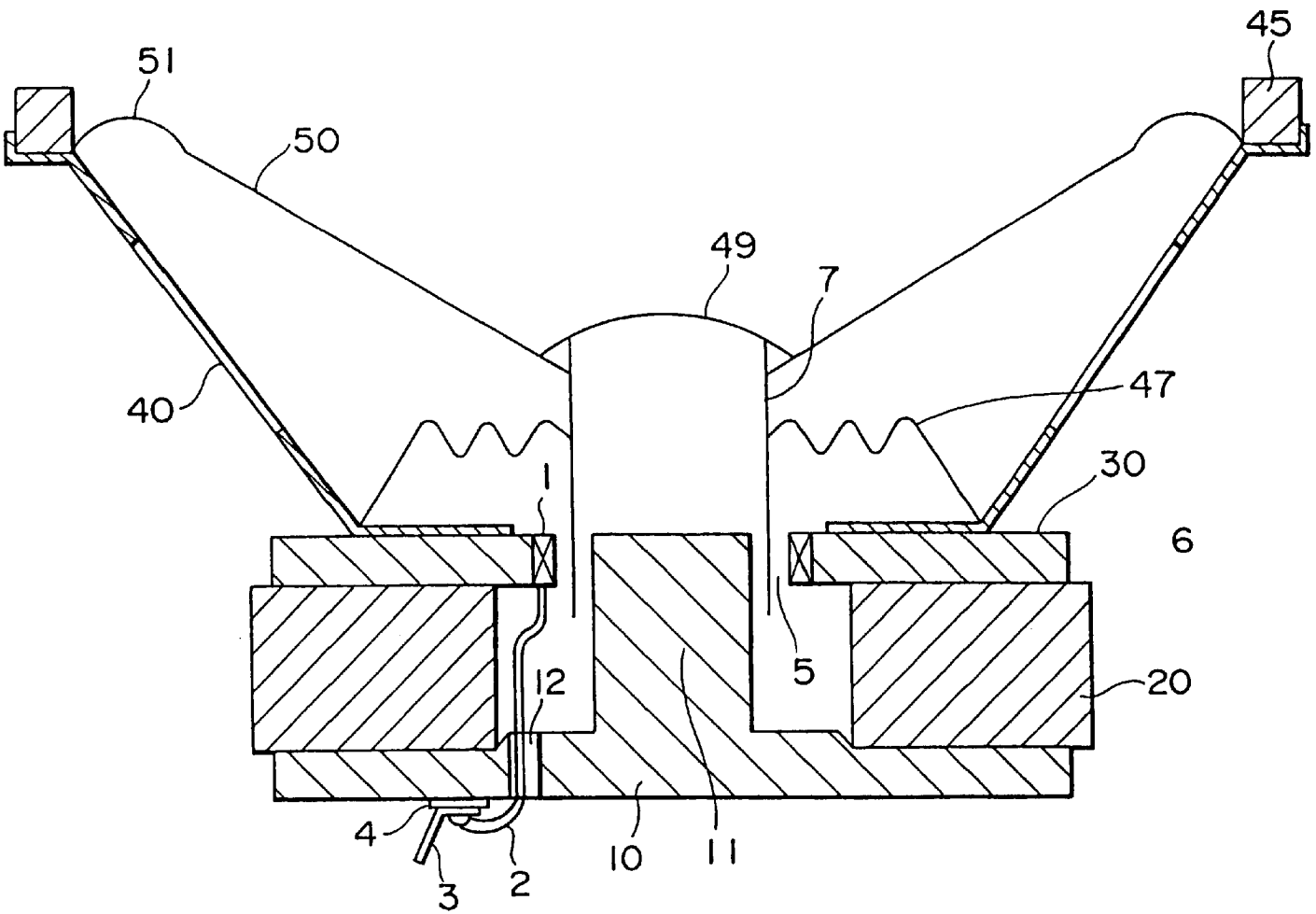
FIGS. 13 and 14 are cross-sectional view showing examples of electromagnetic induction type speakers according to the related art, respectively.
Figure 14:
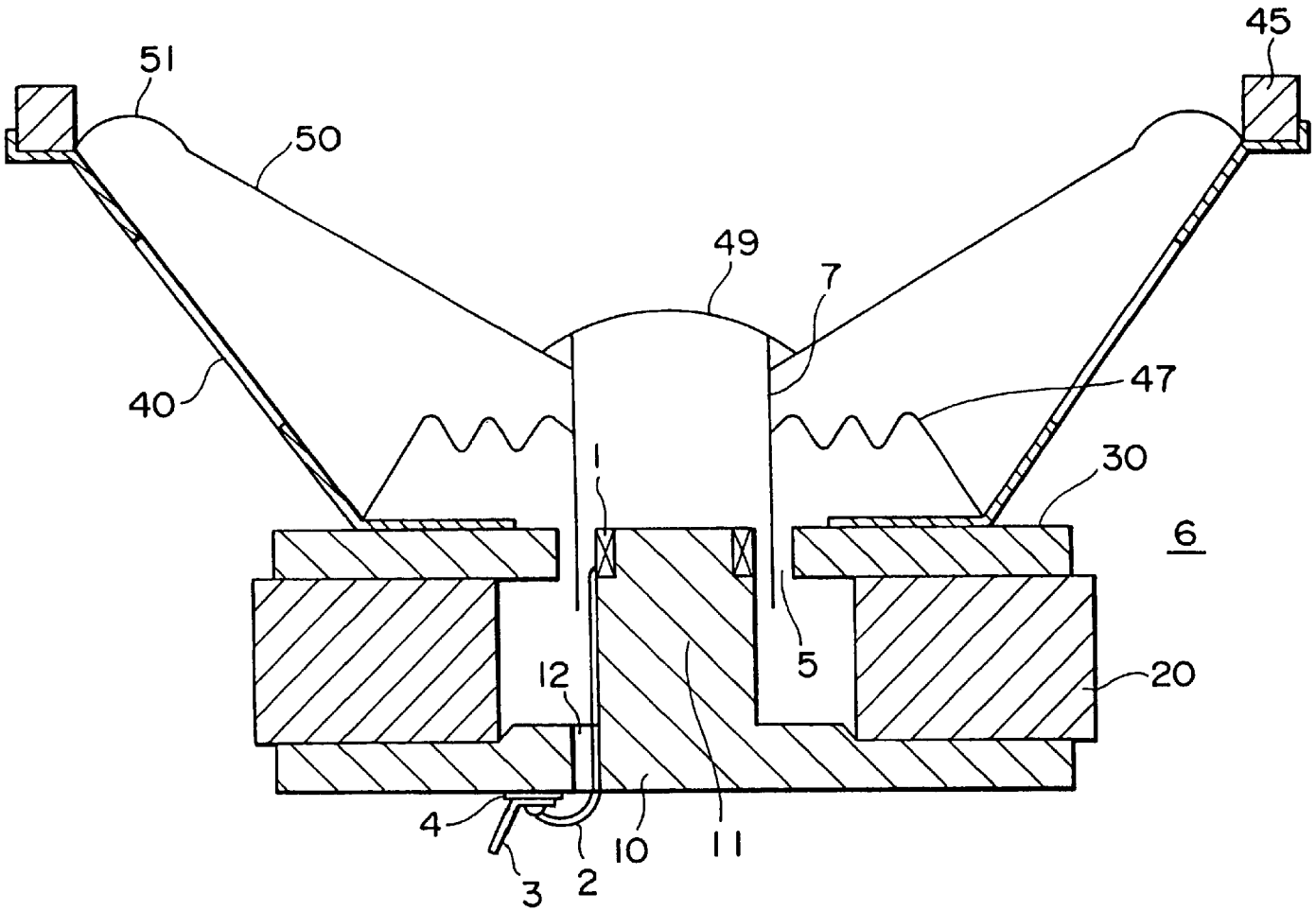

FIG. 11 is a block diagram showing an example of a speaker apparatus including a drive apparatus unit. As shown in FIG. 11, a digital audio signal Ds obtained after inputted data from a CD (compact disc) player or a DAT (digital audio tape recorder) has been digitized into 16-bit digital data at a sampling frequency of 44.1 kHz or 48 kHz is supplied to a serial-to-parallel (S/P conv) converter 110, in which it is converted into a digital audio signal Dp of parallel data.

The 16-bit digital audio signal Dp of parallel data is linearly quantized by two's complement code as shown in FIG. 12. A decoder 120 decodes such a digital audio signal Dp to generate four control signals G1 to G4, which will be described later on, with respect to each of 2SB to LSB (least significant bit) of low-order 15 bits except MSB (most significant bit) in which case the MSB of the digital audio signal Dp is used as a sign bit.

The speaker includes the three drive coils 1S, 1T, 1U of flat and cylindrical winding. Each of the drive coils 1S, 1T, 1U is divided along the axis 0–0' direction to provide the five coils 1E to 1A, 1J to 1F and 1O to 1K each of which has the equal number of turns as shown in FIG. 9. Alternatively, each of the drive coils 1S, 1T, 1U is divided along the axis 0–0' direction to provide the five coils 1E to 1A, 1J to 1F and 1O to 1K in which the ratio of the number of turns becomes N:N/2:N/4:N/8:N/16.

Then, as shown in FIG. 12, the coil 1A is associated with the LSB of the digital audio signal Dp. The coils 1B, 1C, . . . , 1N, 1O will hereinafter be associated with 15SB, 14SB, . . . , 3SB, 2SB of the digital audio signal Dp. Then, as shown in FIG. 11, there are provided coil drive circuits 60A, . . . , 60N, 60O in response to the coils 1A, . . . , 1N, 1O, respectively.

As shown in FIG. 11, the coil drive circuit 60A, for example, comprises a constant current source 65A, four FETs (field-effect transistors) 61 to 64 serving as switching elements and the corresponding coil 1A which are connected in a bridged connection fashion. When the FETs 61, 63 are held at ON state and the FETs 62, 64 are held at OFF state, a current Ia of the constant current source 65A is flowed to the coil 1A in the positive direction. When the FETs 61, 63 are held at OFF state and the FETs 62, 64 are held at ON state, the current Ia of the constant current source 65A is flowed to the coil 1A in the negative direction. When the FETs 61 to 64 are all held at ON or OFF state, the current Ia is not flowed to the coil 1A. This is also true in other coil driving circuits.

Then, the control signals G1 to G4 outputted from the decoder 120 with respect to the 2SB, 3SB, . . . , LSB of the digital audio signal Dp are supplied to the gates of the FETs 61 to 64 of the corresponding coil drive circuits 60O, 60N, . . . , 60A, respectively.

With respect to the control signals G1 to G4, when the MSB of the digital audio signal Dp is 0 and corresponding low-order bits are 1, the control signals G1, G3 are held at the level in which the FETs 61, 63 are turned ON, and the control signals G2, G4 are held at the level in which the FETs 62, 64 are turned OFF. When the MSB is 0 and corresponding low-order bits are 0 or when the MSB is 1 and corresponding low-order bits are 1, the control signals G1 to G4 are held at the level in which the FETs 61 to 64 are turned OFF. When the MSB is 1 and corresponding low-order bits are 0, the control signals G1, G3 are held at the level in which the FETs 61, 63 are turned OFF, and the control signals G2, G4 are held at the level in which the FETs 62, 64 are turned ON.

Therefore, under the condition that the MSB is 0, only when a certain low-order bit is 1, then a signal current is flowed to a corresponding coil in the positive direction. Conversely, under the condition that the MSB is 1, only when a certain low-order bit is 0, a signal current is flowed to a corresponding coil in the negative direction.

A drive force F of a vibration system of an electric acoustic transducer of an electromagnetic coupling type such as an electromagnetic coupling speaker is expressed by a product of a secondary current i induced in a secondary coil, a density B of magnetic flux generated in a magnetic gap of a magnetic circuit and a length L of a secondary coil disposed within the magnetic gap of the magnetic circuit as F=Bli. Since the magnetic flux density B and the length L are constant, the drive force F of the vibration system becomes proportional to the secondary current i induced in the secondary coil. Then, the secondary current i induced in the secondary coil is in proportion to a product of a signal current flowed to a drive coil (primary coil) and the number of turns of the drive coil.

Then, when the number of turns of the 15 coils 1A to 1O is equal as shown in FIG. 9, currents Ib, Ic, Id, . . . of the constant current sources 65B, 65C, 65D, . . . of the coil drive circuits 60B, 60C, 60D, . . . corresponding to the coils 1B, 1C, 1D, . . . corresponding to 15SB, 14SB, 13SB, . . . of the digital audio signal Dp are set on the basis of a relationship of the current Ia of the constant current source 65A of the coil drive circuit 60A corresponding to the coil 1A corresponding to the LSB of the digital audio signal Dp as Ib=2Ia, Ic=2Ib=4Ia, Id=2Ic=8Ia.

Accordingly, in this case, as shown in FIG. 3, the diaphragm 50 with the secondary coil 7 fixed thereto is displaced by an amount proportional to the weights of the bits corresponding to the 15 coils 1A to 1O in the direction corresponding to the value of the MSB of the digital audio signal Dp, whereby the digital audio signal Dp is reproduced with a high fidelity.

Further, as shown in FIG. 10, when the ratio of the number of turns of the coils 1E, 1J, 1O and the coils 1D, 1I, 1N and the coils 1C, 1H, 1M and the coils 1B, 1G, 1L and the coils 1A, 1F, 1K is set to N:N/2:N/4:N/8:N/16, currents Ib, Ic, Id, Ie, If, Ig, Ih, Ii, Ij, Ik, Il, Im, In, Io of the constant current sources 65B, 65C, 65D, 65E, 65F, 65G, 65H, 65I, 65J, 65K, 65L, 65M, 65N, 65O of the coil drive circuits 60B, 60C, 60D, 60E, 60F, 60G, 60H, 60I, 60J, 60K, 60L, 60M, 60N, 60O corresponding to 15SB, 14SB, 13SB, 12SB, 11SB, 10SB, 9SB, 8SB, 7SB, 6SB, 5SB, 4SB, 3SB, 2SB of the digital audio signal Dp are set on the basis of a relationship of the current Ia of the constant current source 65A of the coil drive circuit 60A corresponding to the coil 1A corresponding to the LSB of the digital audio signal Dp as Ia=Ib=Ic=Id=Ie, If=Ig=Ih=Ii=Ij=32Ia, Ik =I1=Im=In=Io=32If=32×32Ia.

Accordingly, also in this case, the diaphragm 50 with the secondary coil 7 fixed thereto is displaced by the weights of the bits corresponding to the 15 coils 1A to 1O in the direction corresponding to the value of the MSB of the digital audio signal Dp, whereby the digital audio signal Dp is reproduced with a high fidelity. In addition, in this case, a ratio of current values between the minimum current value and the maximum current value can be reduced as small as 1:32×32.

Figure 4:
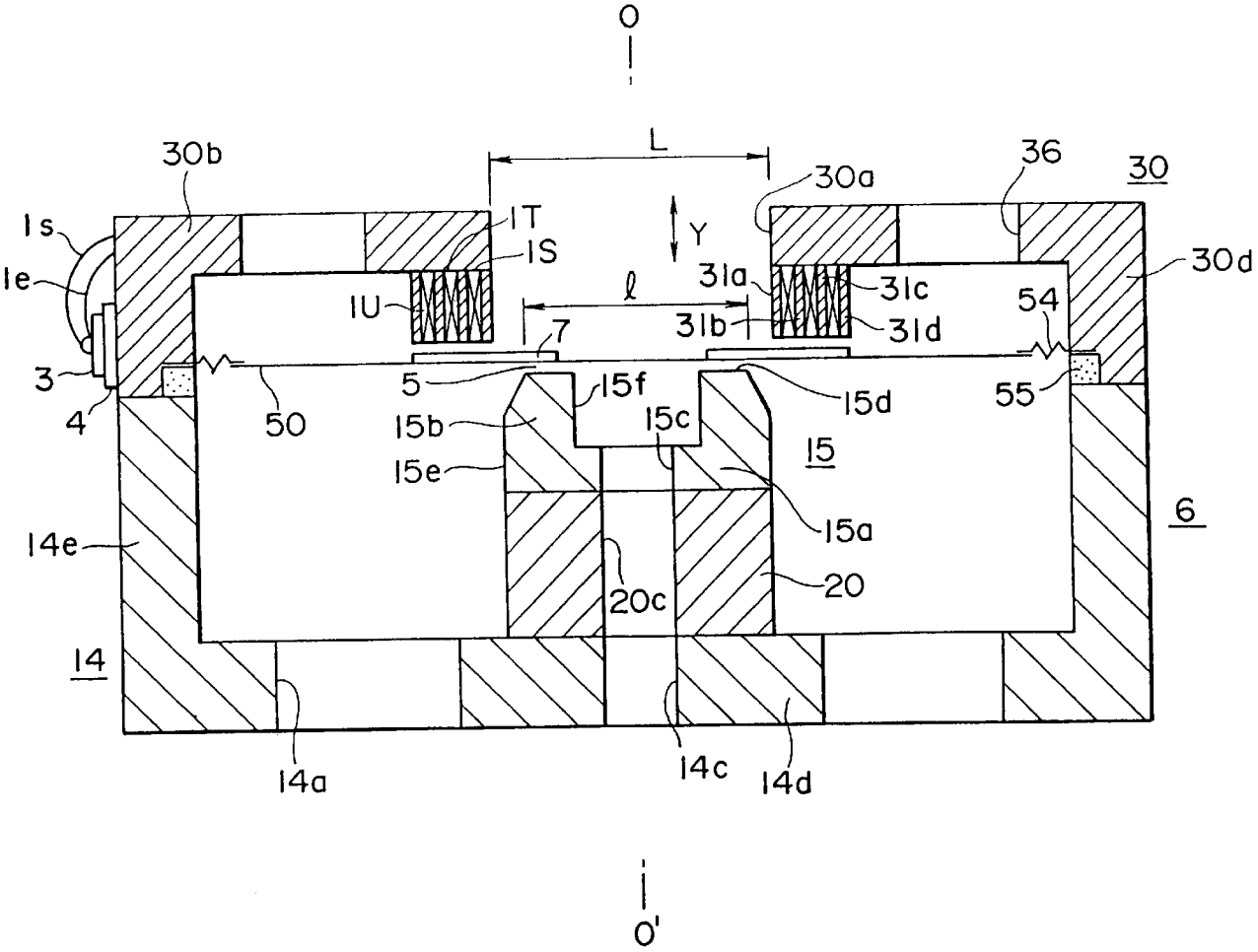
FIG. 4 is a cross-sectional view showing an acoustic transducer according to a fourth embodiment of the present invention in an enlarged scale.

In the fourth embodiment shown in FIG. 4, the inner cylindrical body 3*c* shown in FIG. 1 comprises four first to fourth cylindrical bodies 31*a* to 31*d* of different diameters made of a magnetic material different from that of the plate 30. Then, drive coils 1S to 1U are respectively disposed between the four first to fourth cylindrical bodies 31*a* to 31*d* which are disposed concentrically. Specifically, the drive coil 1S is disposed between the first and second cylindrical bodies 31*a* and 31*b;* the drive coil 1T is disposed between the second and third cylindrical bodies 31*b* and 31*c;* and the drive coil 1U is disposed between the third and fourth cylindrical bodies 31*c* and 31*d* and thereby bonded, respectively. The assembly thus made is bonded to the plate 30 as shown in FIG. 4. According to the above-mentioned arrangement, the present invention may easily be applied to the speaker which is driven by the digital audio signal as shown in FIG. 3.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. An electromagnetic induction type acoustic transducer comprising:

a plate forming a part of a magnetic circuit and having an opening of a predetermined diameter about a central axis;

a pole piece forming a part of said magnetic circuit protruded on said central axis and having an outer peripheral diameter smaller than said opening of said plate and having an upper surface located lower than a lower surface of an opening peripheral portion of said plate by a predetermined distance, wherein a lower surface portion of said opening peripheral portion of said plate and an upper surface portion of said pole piece constitute a magnetic gap of said magnetic circuit;

a diaphragm formed of non-magnetic material vibrated in upper and lower directions relative to said plate and pole piece on said central axis and being arranged at a position perpendicular to said central axis between said plate and said pole piece;

an annular secondary coil attached to said diaphragm at the position of said magnetic gap; and a drive coil attached to one of said plate and said pole piece.

2. The electromagnetic induction type acoustic transducer as claimed in claim 1, wherein said drive coil is formed of a wire wound around said central axis in a spiral staircase fashion.

3. An electromagnetic induction type acoustic transducer having a diaphragm, said transducer comprising:

a plate disposed at an upper position relative to a diaphragm, which is vibrated in upper and lower directions, said plate being arranged at a predetermined distance from said diaphragm;

a pole piece disposed at a lower position relative to said diaphragm and being arranged at a predetermined distance from said diaphragm;

an annular secondary coil attached to said diaphragm in such a manner that said annular secondary coil is in a magnetic flux path obliquely crossing a magnetic gap formed between said plate and said pole piece; and a drive coil attached to one of said plate and said pole piece.

4. The electromagnetic induction type acoustic transducer as claimed in claim 1, wherein said drive coil is arranged on an outer peripheral surface of said pole piece at said magnetic gap of said magnetic circuit.

5. The electromagnetic induction type acoustic transducer as claimed in claim 1, wherein said drive coil is arranged on an inner peripheral surface of said opening in said plate at said magnetic gap of said magnetic circuit.

6. An electromagnetic induction type acoustic transducer comprising:

a plate forming a part of a magnetic circuit and having an opening of a predetermined diameter formed therein about a central axis and an inner cylindrical body formed about said opening;

a pole piece forming a part of said magnetic circuit protruded on said central axis and having an outer diameter smaller than said predetermined diameter of said opening and having an upper surface located below a lower surface of said inner cylindrical body of said plate by a predetermined distance, wherein said lower surface of said inner cylindrical body of said plate and said upper surface of said pole piece constitute a magnetic gap of said magnetic circuit;

a drive coil having a first portion arranged on said plate at said magnetic gap and a second portion arranged on said pole piece at said magnetic gap;

a diaphragm mounted at a position perpendicular to said central axis between said plate and said pole piece and being arranged to vibrate in upper and lower directions relative to said plate and said pole piece; and an annular secondary coil attached to said diaphragm at said magnetic gap.

7. The electromagnetic induction type acoustic transducer as claimed in claim 6, wherein said first portion of said drive coil is arranged on said inner cylindrical body formed about said opening in said plate.

8. The electromagnetic induction type acoustic transducer as claimed in claim 6, wherein said pole piece has a central opening formed in said upper surface and said second portion of said drive coil is arranged in said central opening at said position of said magnetic gap.

* * * * *